US006382608B1

(12) United States Patent
Michell

(10) Patent No.: US 6,382,608 B1
(45) Date of Patent: May 7, 2002

(54) ADJUSTABLE CLAMPING AND SPREADING BAR CLAMP OR BENCH VICE

(76) Inventor: Steven W. Michell, Box 488, 7291 51st Street NE., Canoe, British Columbia (CA), V0E 1K0

( * ) Notice: Subject to any disclaimer, the term of this patent is extended or adjusted under 35 U.S.C. 154(b) by 0 days.

(21) Appl. No.: 09/699,393

(22) Filed: Oct. 31, 2000

(51) Int. Cl.[7] ..... B25B 1/02
(52) U.S. Cl. ..... 269/6; 269/170
(58) Field of Search ..... 269/165–171.5, 269/147–150, 6, 3; 81/487; 259/106–111

(56) References Cited

U.S. PATENT DOCUMENTS 5,853,168 A * 12/1998 Drake ..... 269/6
6,254,073 B1 * 7/2001 Noniewicz et al. ..... 269/6

FOREIGN PATENT DOCUMENTS

WO WO 99/04932 2/1999
WO WO 99/44789 9/1999

* cited by examiner

*Primary Examiner*—Robert C. Watson
(74) *Attorney, Agent, or Firm*—Antony C. Edwards

(57) ABSTRACT

An adjustable clamping and spreading bar clamp or bench vice includes a fixed jaw and a movable jaw opposing the fixed jaw, where the fixed jaw and the movable jaw each include two jaw pads facing in opposite directions. The movable jaw connects at one end to a slide bar, which is movable to bring the movable jaw toward and away from the fixed jaw, the movable jaw includes means to releasably engages the slide bar and advances the movable jaw toward the fixed jaw or moves the movable jaw away from the fixed jaw for spreading or jacking. A two-way drive means is operational by a trigger handle grip. Also included is a pair of mechanical detent switches, which are rotated approximately ¼ revolution, to either change the direction of the movable jaw, or release the clamp after either clamping or spreading.

17 Claims, 11 Drawing Sheets

ADJUSTABLE CLAMPING AND SPREADING BAR CLAMP OR BENCH VICE

FIELD OF THE INVENTION

This invention relates to adjustable bar clamps and bench vises, and more specifically adjustable bar clamps and vices that can be used for clamping and spreading workpieces without the need for physically changing or rearranging of parts.

BACKGROUND OF THE INVENTION

This invention relates generally to adjustable bar clamps used to quickly and easily clamp two articles together, for example, for gluing, or to hold a workpiece for some other operation, and more specifically, to a bar clamp or bench clamp capable of clamping and spreading workpieces with substantial and equal force and without disassembly, detachments and rearrangement being made to the device.

Pipe or bar clamps of various configurations are well known, such as traditional wood gluing clamps, as used by woodworkers. These known clamps are often effective only when used for the specific purpose that they were made, however there are a few clamps that can be used for both clamping and spreading. There are many needs for a spreader, one such use is to dismantle doweled chair legs, where it is desirable to remove all dowels that need gluing, some of which may be slightly loose when the chair is sat on, but are not easily pulled apart by hand and using a hammer is not appropriate and will often causes damage to the parts.

Known clamps that are capable of both clamping and spreading require alterations, which normally involve the attachment and reattachment of the fixed jaw from one end of the bar to the other end, and where this jaw is rotated 180 degrees before attachment so that the clamp pad is facing either in for clamping, or facing out spreading.

Inventor is aware of PCT Application PCT/EP98/03915 "Clamping Tool, Especially A Clamping Clip, Clamping Rod Or Clamping Bench", filed by Wolfcraft GMBH. The invention relates to a clamping tool with a clamping area between a first mobile clamping jaw and a fixed second clamping jaw, which rests on a housing. A pivoting handle is displaced causing the pull rod to displace progressively in such a way that the first mobile clamping jaw is moved towards the second fixed clamping jaw. The clamping tool also has a backpressure lock and a release lever for releasing the backpressure lock. Both the pivoting handle and the release lever are located on the housing, on the side of the grip facing away from the clamping area and the mobile clamping jaw can be moved back (moved OR "displaced" only), and no mechanism for spreading and holding bar or rod once displaced back by operating the release lever. If spreading is desired, the fixed jaw must be detached by removing a bolt, then replacing and bolting the fixed jaw in a 180 degree rotated position on the opposite end of the bar or "pull rod".

Inventor is also, aware of U.S. Pat. No. 5,853,168 Bar Clamp For Single-Hand Operation, issued to Drake, Dec. 29, 1998 A bar clamp for single hand operation; includes a housing, a fixed jaw and a movable jaw mounted on one end of a slide bar for movement in a direction toward the fixed jaw. A spring-loaded driving key is secured on the slide bar and through operation of a trigger handle engages the slide bar for advancing the movable jaw toward the fixed jaw. A locking key is biased against the slide bar and normally engaged with the slide bar to prevent motion of the second jaw away from the first jaw and actuatable to disengage from the slide bar to allow advancement of the second jaw away from the first jaw. The trigger handle has one end pivotably mounted within the housing and formed with two lateral mounting plates of arched outer configuration. The housing is comprised of a first housing portion and a second housing portion, with at least the driving key and the locking key being accommodated within the housing. No means for spreading are designed into this clamp.

Inventor is also aware of U.S. Pat. No 4,722,999 and continuation-in-part U.S. Pat. No 5,009,134 both issued to Sorenson et al. This clamp has a movable jaw, which is easily movable over a bar to clamp against a workpiece, and is operable with one hand. The movable jaw is connected to one end of a movable slide bar and a stationary jaw is supported on the slide bar by a support structure including a trigger handle grip which releasably engages the slide bar and advances the movable jaw toward the fixed jaw. A new PCT patent application PCT/US99/04961 has been applied by owner American Tool Companies Inc. to improve this clamp for spreading and other enhancements, which includes a quick change fixed jaw, where the fixed jaw is detachable by sliding a locking mechanism, then replacing the fixed jaw in a 180 degree rotated position on the opposite end of the bar and then relocking into position for spreading.

SUMMARY OF THE INVENTION

An adjustable clamping and spreading bar clamp or bench vice includes a fixed jaw and a movable jaw opposing the fixed jaw, where the fixed jaw and the movable jaw each include two jaw pads facing in opposite directions. The movable jaw connects at one end to a slide bar, which is movable to bring the movable jaw toward and away from the fixed jaw, the movable jaw includes means to releasably engages the slide bar and advances the movable jaw toward the fixed jaw or moves the movable jaw away from the fixed jaw for spreading or jacking. A two-way drive means is operational by a trigger handle grip. Also included is a pair of mechanical detent switches, which are rotated approximately ¼ revolution, to either change the direction of the movable jaw, or release the clamp after either clamping or spreading.

Accordingly, it is an object of this invention to provide an improved adjustable bar clamp and spreader wherein in one embodiment the moving jaw may be moved over short and long distances in either direction for positioning and then either clamping or spreading.

It is another object of this invention to provide an adjustable bar clamp which in one embodiment may be used with equal force in either direction for both clamping and spreading, and without detaching and then reattaching parts.

It is yet another object of this invention to provide a mechanism that can be used on a vice or for use on a clamping bench, where the clamping jaws are mounted on two parallel members or bars, and perpendicular to these parallel bars, are clamping boards or jaws that are guided in the substantially parallel direction relative to each other and where as the clamping mechanism and thus the clamping boards or jaws may be actuated by either a hand powered lever or a foot powered pedal.

BRIEF DESCRIPTION OF THE DRAWINGS

Various other objects, features and advantages of the present invention will become more fully appreciated as the same becomes better understood when considered in conjunction with the following detailed description of an illustrative embodiment and the accompanying drawings, in which like reference characters designate the same or similar parts throughout the several views, and wherein.

DETAILED DESCRIPTION OF PREFERRED EMBODIMENTS

Figure 1:
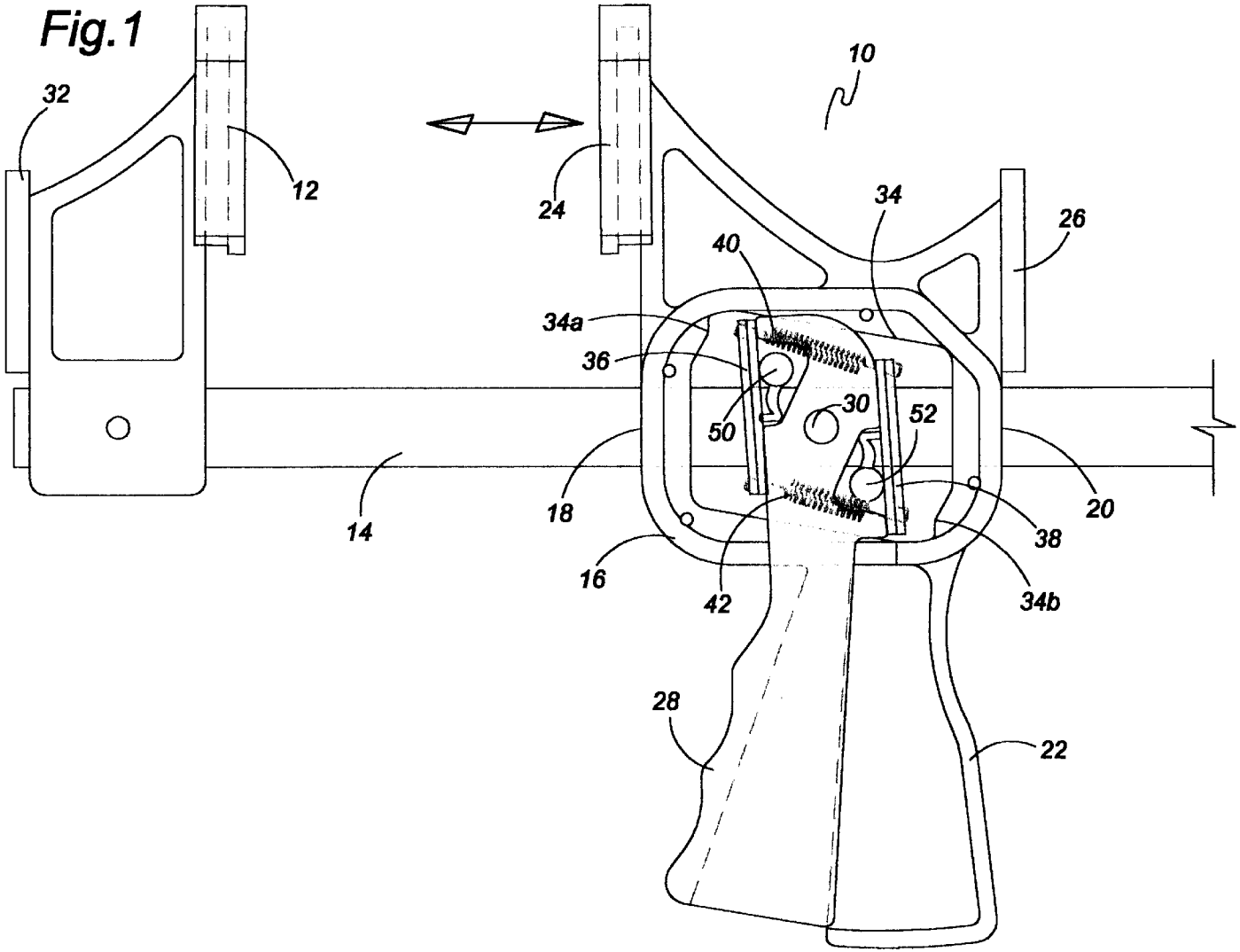
FIG. 1 is a left side view of the adjustable bar clamp showing the detent switches in neutral position.
Figure 2:
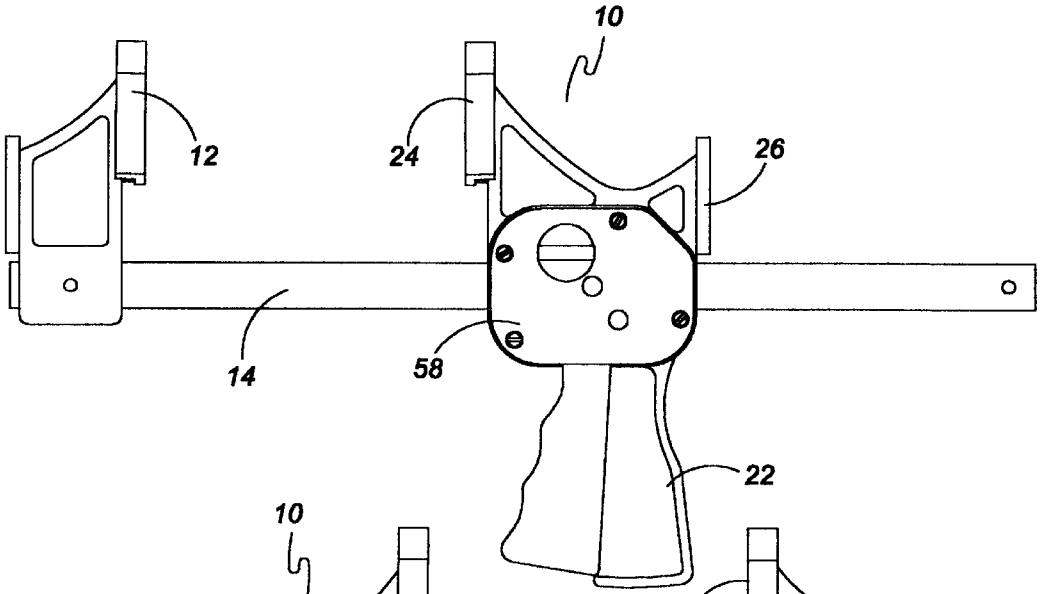
FIG. 2 is a left side view of the adjustable bar clamp.
Figure 3:
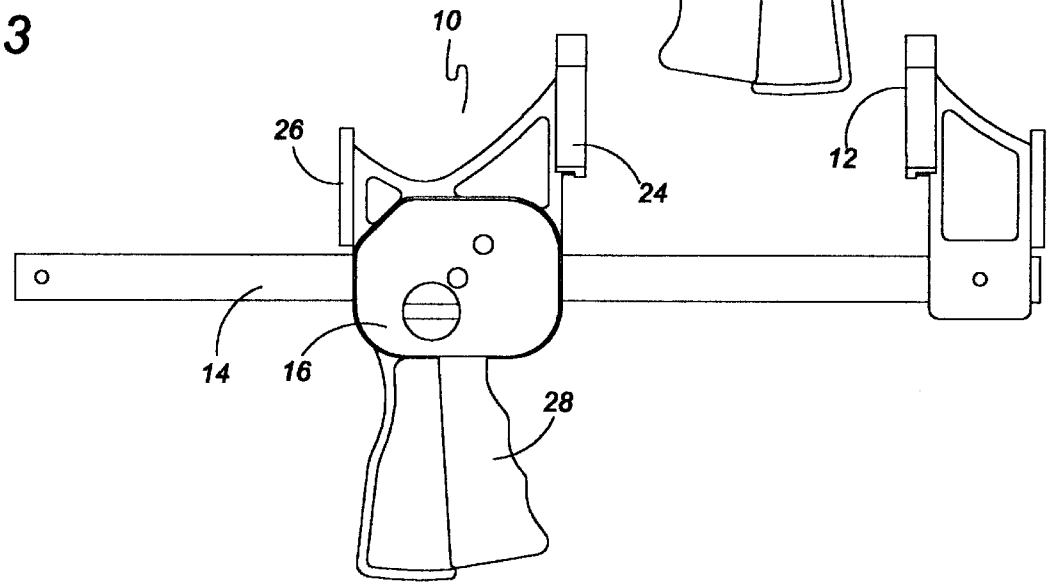
FIG. 3 is a right side view of the adjustable bar clamp.
Figure 4:
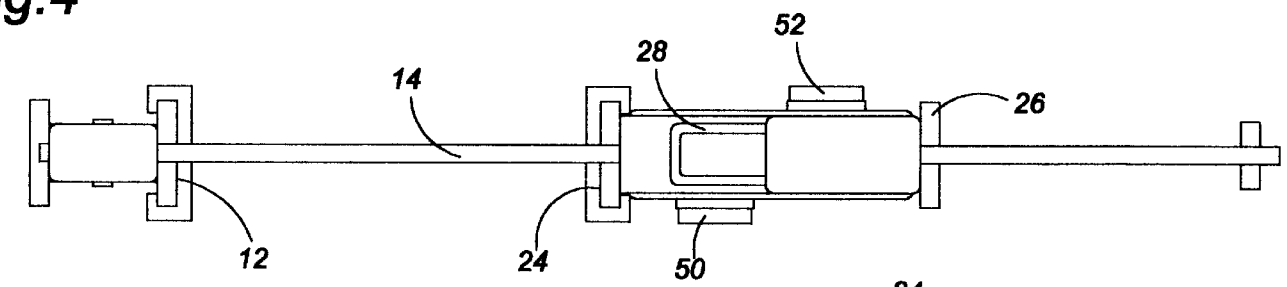
FIG. 4 is a bottom view of the adjustable bar clamp.
Figure 5B:
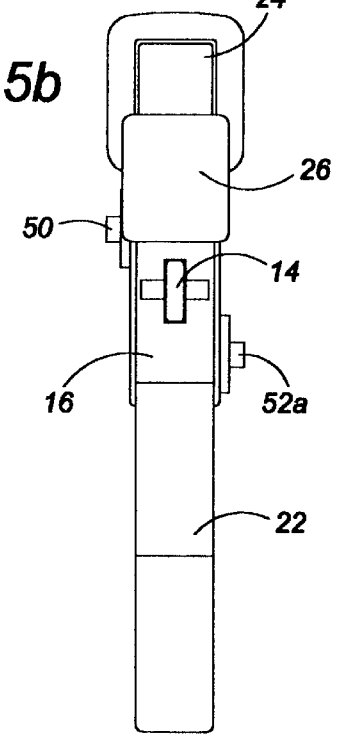
FIG. 5*b* is an end view of the adjustable bar clamp looking at the movable jaw.
Figure 5A:
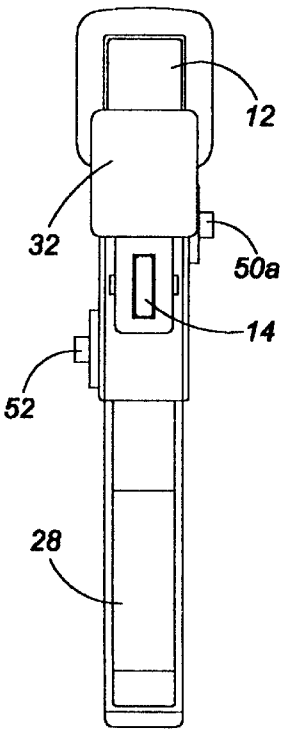
FIG. 5*a* is an end view of the adjustable bar clamp looking at the fixed jaw.

With reference to the Figures, and in particular to FIG. 1, adjustable clamping and spreading bar clamp generally referred to as 10 is shown open and ready for use, where clamp 10 includes a fixed jaw 12 attached to a slide bar 14. The slide bar 14 is slidably supported to movable jaw body assembly 16 through two slots 18 and 20, which pass through body 16.

Jaw body 16 includes a handle grip 22 attached to jaw body 16. A moving clamping jaw 24 is attached to jaw body 16 on the clamping side of jaw body 16 and a moving spreading jaw 26 is attached to body 16 on the spreading side of jaw body 16. A trigger handle 28 is pivotably attached within the center of jaw body 16 by pivot pin 30. The fixed jaw 12 opposes moving clamping jaw 24. Fixed jaw 12 includes a fixed spreading jaw 32.

Figure 12B:
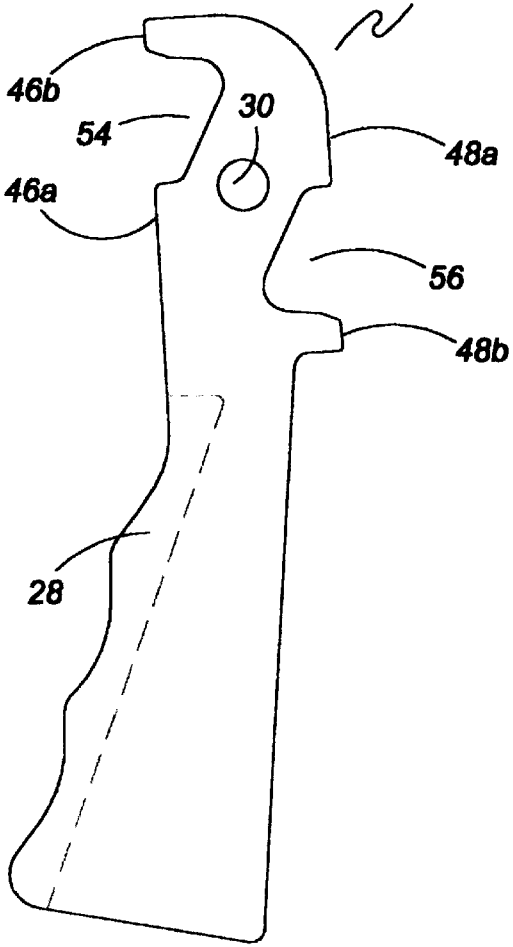
FIG. 12*b* is a side view of trigger handle.
Figure 12A:
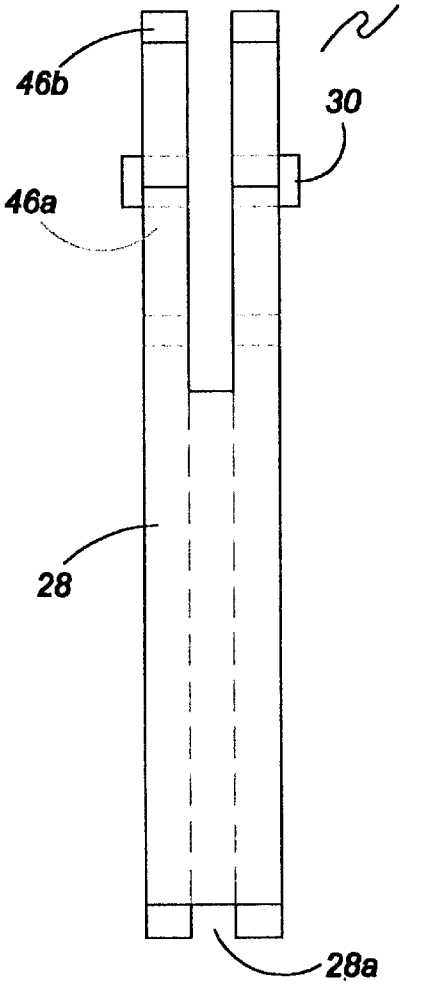
FIG. 12*a* is a front view of trigger handle.

As illustrated in FIGS. 12*a* and 12*b*, trigger handle 28 is void in part, a cavity 28*a* so as to receive the handle grip 22 in a cavity 28*a*. As best illustrated in FIG. 1, trigger handle 28 is positioned within a second cavity 34 within jaw body 16 that lies between slots 18 and 20. A first pressure and brake dog pair 36 is suspended on the slide bar 14 near moving clamping jaw 24, slide bar 14 passes through a hole 36*a* (FIG. 1 la) in the first pressure and brake dog pair 36. There is a second pressure and brake dog pair 38 which is suspended on slide bar 14 near moving spreading jaw 26, slide bar 14 passes through a hole 38*a* in the second pressure and brake dog pair 38.

As best illustrated in FIG. 1, a pair of extension springs 40 and 42 extend between the first pressure and brake dog pair 36 and the second pressure and brake dog pair 38. First pressure and brake dog pair 36 and the second pressure and brake dog pair 38 include extension spring attachment holes 40*a*, 42*a* and 40*b*, 42*b*. An upper end 44 of the trigger handle 28 is forked and straddles slide bar 14. Extension springs 40 and 42 are also straddled by upper trigger handle end 44. Force of the springs 40 and 42 urge first pressure and brake dog pair 36 and the second pressure and brake dog pair 38 against surfaces 46*a*, 46*b* and 48*a* , 48*b* of trigger handle end 44 providing a neutral condition where slide bar 14 can move freely through jaw body assembly 16.

To position the first pressure and brake dog pair 36 and the second pressure and brake dog pair 38 for clamping or spreading and for releasing there is a first detent switch 50 for clamping and a second detent switch 52 for spreading, where first detent switch 50 is positioned above slide bar 14 and second detent switch 52 is positioned below slide bar 14, within voids 54 and 56 of trigger handle end 44. The detent switches 50 and 52 are rotatably supported within body cavity 34 by holes 50*a*, 50*b* and 52*a*, 52*b* in a cover plate 58. Also, trigger handle 28 is rotatably supported in holes 30*a* and 30*b*.

As illustrated in FIG. 6*a*, 6*b*, 7*a* and 7*b*, in operation, user engages either first detent switch 50 for clamping, or second detent switch 52 for spreading, by rotating switch either 50 or 52 approximately ¼ revolution from the release position to either the clamp or spread position, then adjusts the moveable jaw by grasping jaw body 16 and the fixed jaw 12 or slide bar 14 and adjusts jaw body 16 to the approximate distance between movable and fixed jaws as required and then user grasps handle grip 20 and trigger 24 and squeezes together handle grip 20 and trigger 24 to either clamp or spread as needed. As trigger 28 is squeezed, trigger surfaces 46*b* or 48*b* of trigger handle end 44 contact either the first pressure and brake dog pair 36 or the second pressure and brake dog pair 38 for clamping or spreading.

Figure 6A:
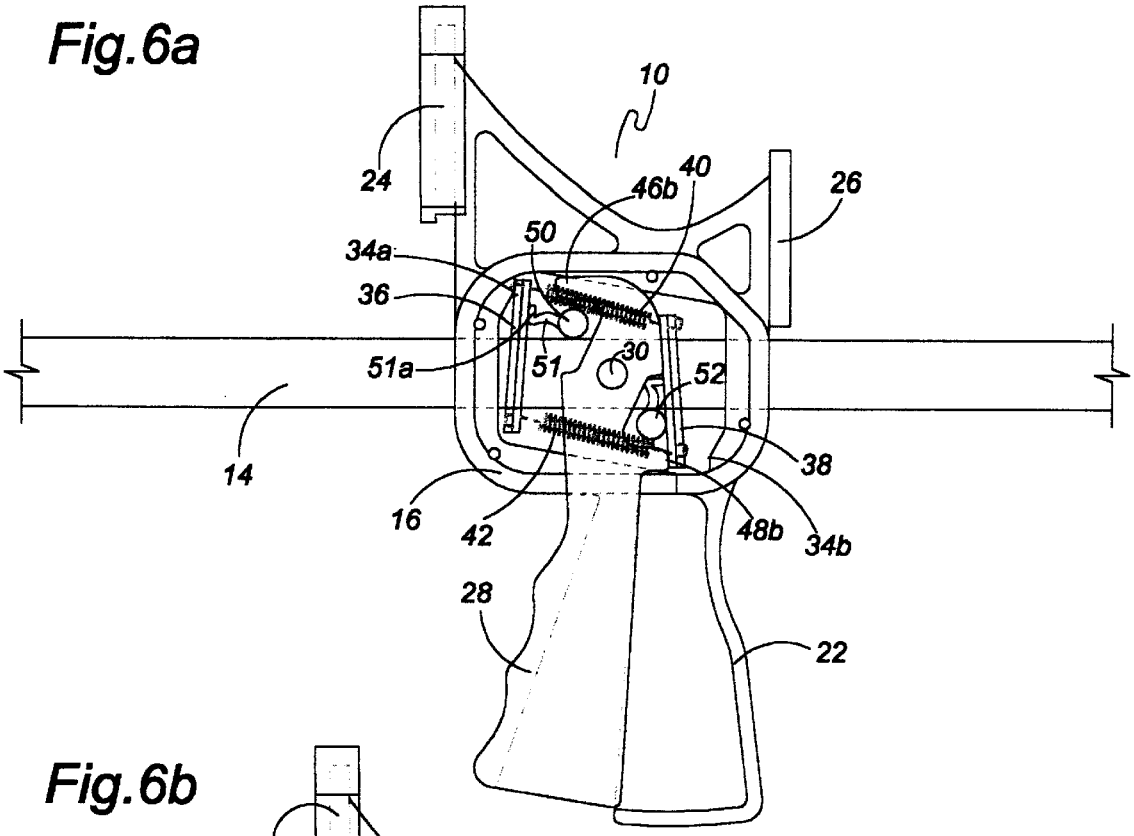
FIG. 6*a* is a left side view of the adjustable bar clamp showing the detent switches in position for clamping.
Figure 6B:
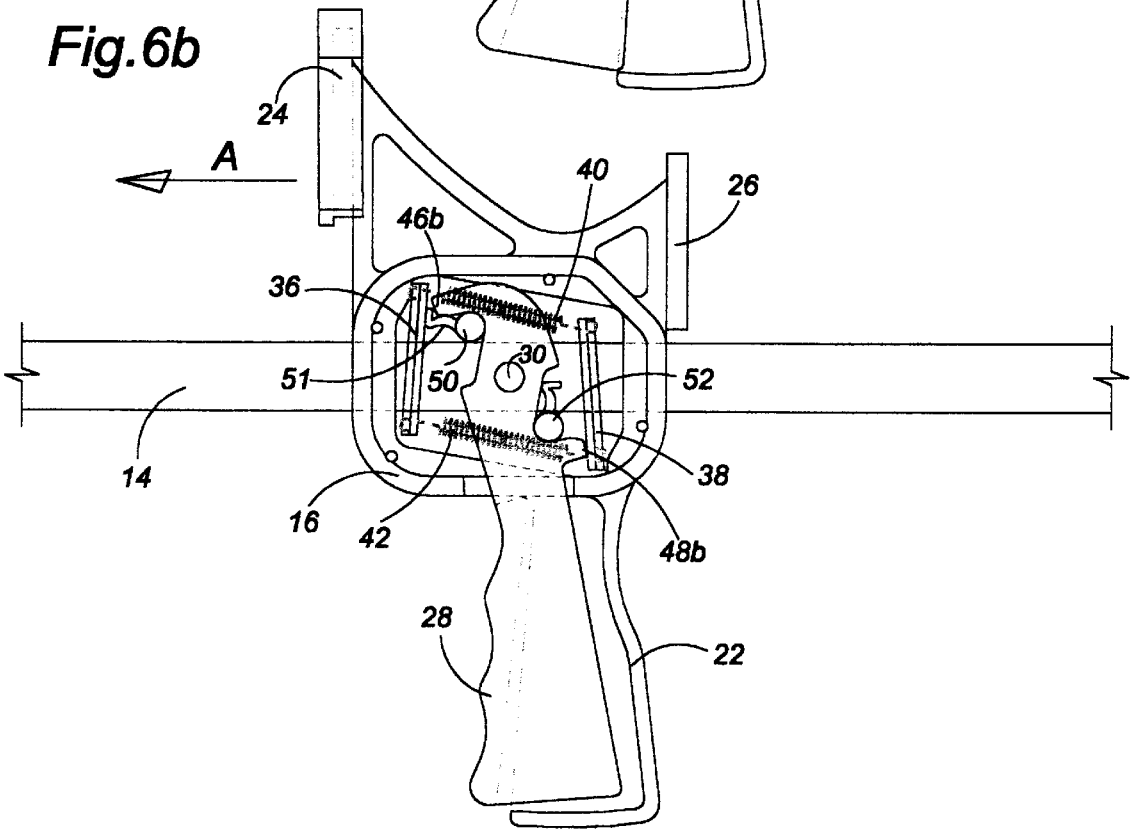
FIG. 6*b* is a left side view of the adjustable bar clamp showing the detent switches in position for clamping where the trigger has been squeezed.

To use for clamping, a user turns detent switch 50 so as to point leg 51 and foot 51*a* of leg 51 generally parallel along bar 14 as seen in FIG. 6*a*. Leg 51 and foot 51*a* so positioned stabilizes and supports dog pair 36 against protrusion 34*a* of body 16, thereby allowing biased movement only of bar 14. With the housing cover on, this movement corresponds to rotating knob 50*a* of switch 50 so as to indicate the word "clamp" or the like on the housing cover. The jaws may then be slid together in direction A only, but not slid apart, so as to abut a workpiece between the jaws. The trigger 28 is then squeezed as seen in FIG. 6*b* until tight thereby tightening the jaws onto the workpiece. In particular, squeezing trigger 28 rotates trigger surface 48*b* about pin 30 forcing a corresponding rotation of dog pair 38 relative to bar 14. This rotation pinches bar 14 within the longitudinally distal ends of hole 38*a* in dog pair 38. With bar 14 thus gripped within dog pair 38, further rotation of trigger 28 and trigger surface 48*b* about pin 30 drives longitudinal translation of bar 14 such as illustrated in the longitudinal translation of bar 14 between FIGS. 6*a* and 6*b*. Releasing trigger 28 allows for its return rotation about pin 30 under the resiliently biasing force of spring 42 urging dog pair 38 and surface 48*b* in a return direction relative to bar 14 thereby releasing the grip of dog pair 38 on bar 14 and allowing dog pair 38 to slide over bar 14 so as to return to the position of FIG. 6*a* ready for the user to again squeeze trigger 28. During this clamping sequence, the rotation of switch 50 so as to rotate leg 51, and in particular foot 51*a* , against dog pair 36 stabilizes and supports dog pair 36 in a stand-off position relative to trigger surface 46*b* as trigger 28 is rotated about pin 30. With dog pair 36 so supported and stabilized, dog pair 36 allows translation of bar 14 as trigger 28 is squeezed, but once trigger 28 is released, clamps bar 14 to prevent a return translation of bar 14 relative to jaw 24.

When it is desired to release the clamped workpiece, switch 50 is rotated so as to rotate leg 51 and foot 51*a* out of engagement with dog pair 36. In use, this corresponds to rotating knob 50*a* of switch 50 which also advantageously corresponds to knob 50*a* indicating the word "release" or the like on the housing cover. Trigger 28 is squeezed until a click is heard, indicating that bar 14 may then be slid freely.

Figure 7A:
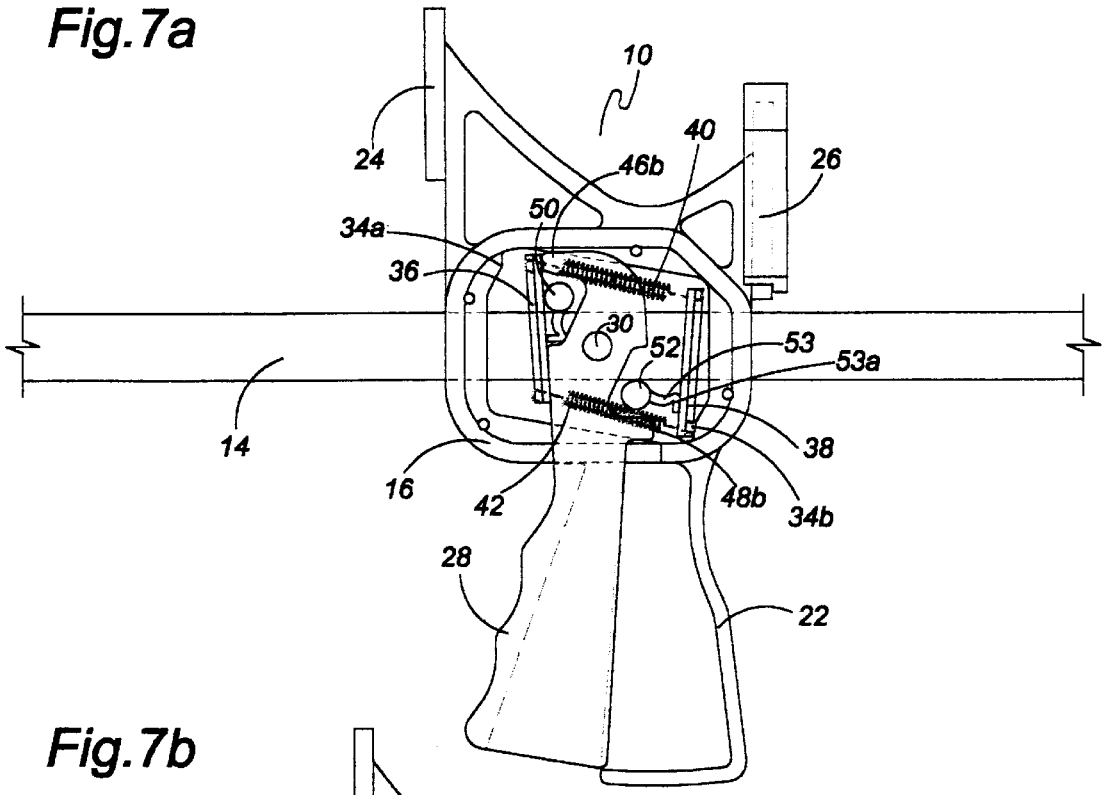
FIG. 7*a* is a left side view of the adjustable bar clamp showing the detent switches in position for spreading.
Figure 7B:
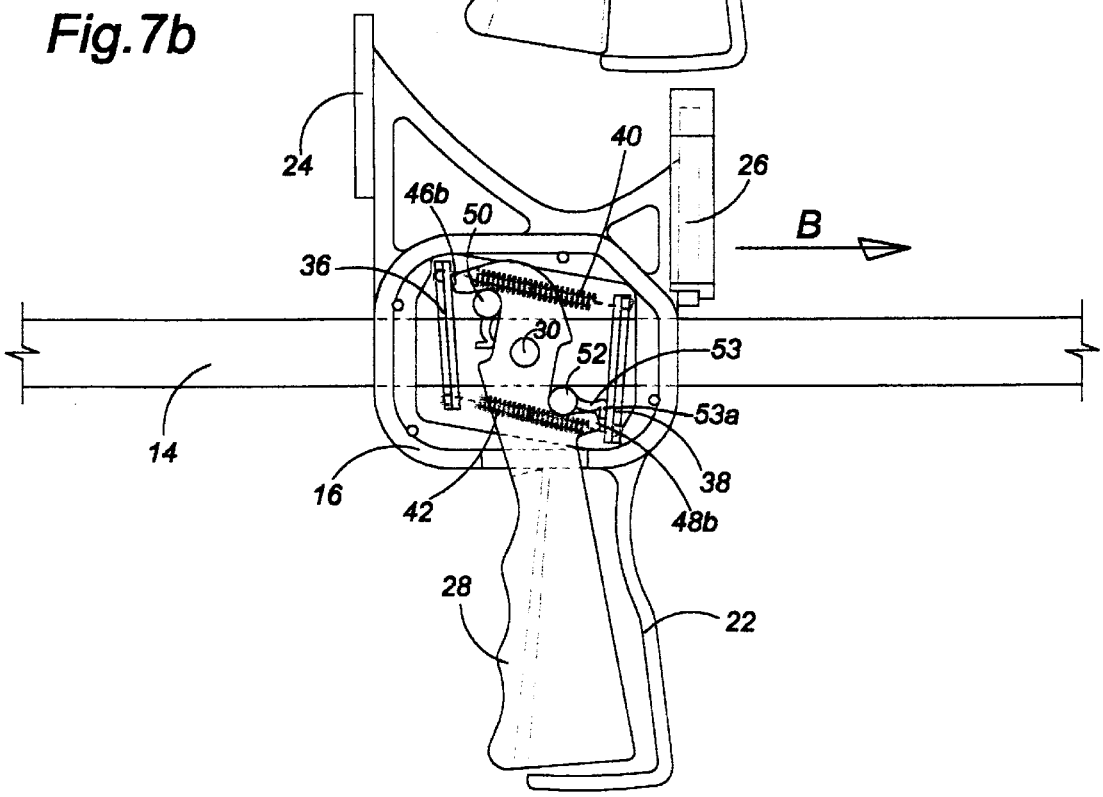
FIG. 7*b* is a left side view of the adjustable bar clamp showing the detent switches in position for spreading where the trigger has been squeezed.
Figure 9:
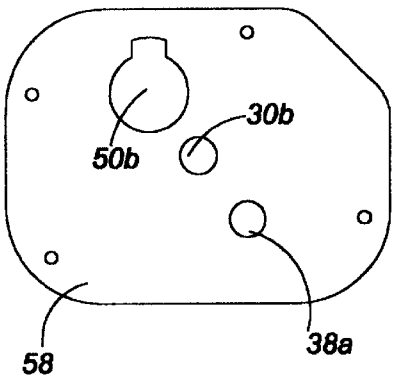
FIG. 9 is a left side view of the adjustable bar clamp showing the movable jaw body cover plate.
Figure 8:
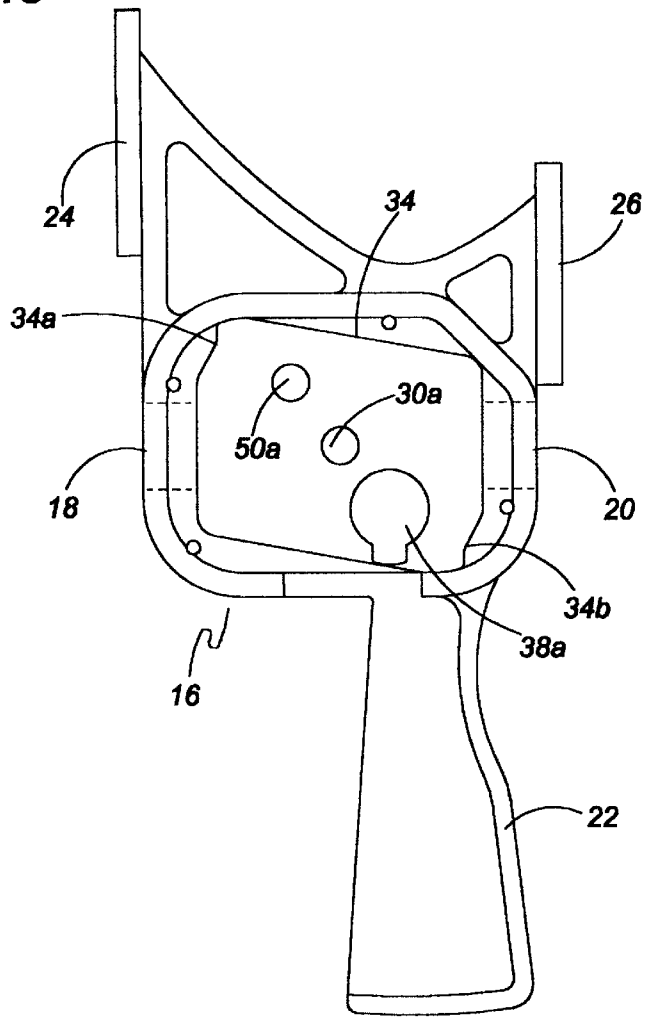
FIG. 8 is a left side view of the adjustable bar clamp showing the movable jaw body only.
Figure 10C:
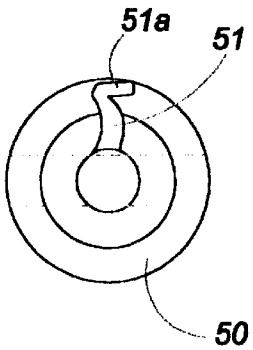
FIG. 10*c* is a right side view of a detent switch.
Figure 10B:
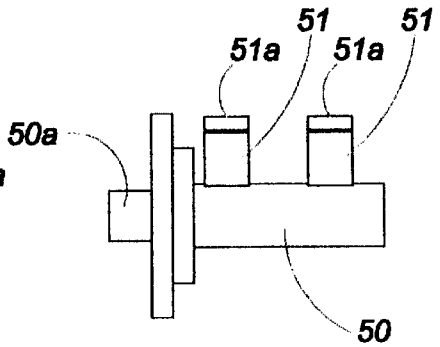
FIG. 10*b* is an end view of a detent switch.
Figure 10A:
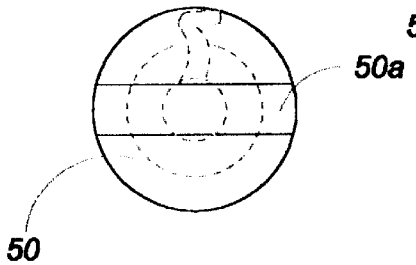
FIG. 10*a* is a left side view of a detent switch.
Figure 11C:
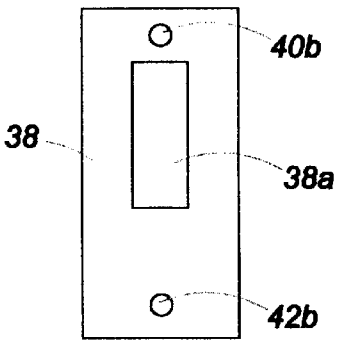
FIG. 11*c* is an end view of a single second pressure and brake dog from a pair.
Figure 11B:
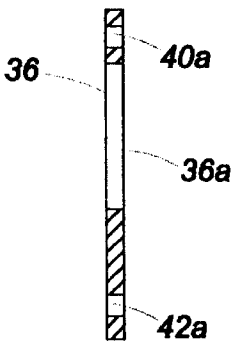
FIG. 11*b* is a side sectional view of a single first pressure and brake dog from a pair taken from FIG. 11*a*.
Figure 11A:
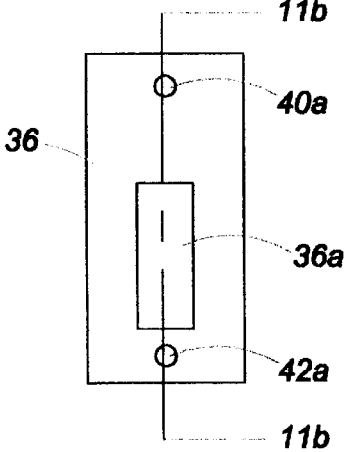
FIG. 11*a* is an end view of a single first pressure and brake dog from a pair.

For use in spreading, a user turns detent switch 52, the knob for which may be located on the opposite side of the clamp housing so that leg 53 and foot 53*a* are generally parallel along bar 14 as seen in FIG. 7*a*, in an opposite direction to that correspondingly described for leg 51 when used for clamping. With the clamp housing cover on, this movement of switch 52 corresponds to rotating knob 52*a* of switch 52 so as to indicate the word "spread" or the like on the housing cover. With leg 53 and foot 53*a* so positioned so as to stabilize and support dog pair 38 against protrusion 34*b* of body 16, thereby allowing biased movement only of bar 14, the jaws may be spread apart in direction B only, but not slid together, so as to engage the workpiece to be spread. Trigger 28 is then squeezed by the user so as rotate trigger 28 about pin 30. This forces surface 46*b* against dog pair 36 thereby longitudinally translating bar 14 so as to spread jaw 26 apart relative to jaw 32. This longitudinal translation of bar 14 corresponds to the movement illustrated between FIGS. 7*a* and 7*b*.

Release of squeezing pressure on trigger 28 allows the return rotation of trigger 28 about pin 30 under the return biasing force of spring 40 pulling on dog pair 36 against trigger surface 46*b*. This also releases dog pair 36 from pinched engagement with bar 14 so that dog pair 36 returns from its position of FIG. 7*b* to its position of FIG. 7*a* under the resilient biasing of both springs 40 and 42. Trigger 28 may then again be squeezed to continue longitudinal translation of bar 14 through housing 16 until jaws 26 and 32 are snugged in spreading compression against the workpiece.

Foot 53*a* on leg 53 stabilizes and supports dog pair 38 so that during spreading longitudinal translation of bar 14 as trigger 28 is squeezed, bar 14 is allowed to slide through hole 38*a* as bar 14 is gripped or pinched within hole 36*a* on dog pair 36, dog pair 38 resisting a return translation of bar 14 once pressure is released on trigger 28.

To release the spreading compression of the workpiece, switch 52 is rotated, for example until knob 52*a* indicates the word "release" on the housing cover. Trigger 28 is then squeezed until a click is heard indicating that bar 14 may be slid freely.

Figure 15:
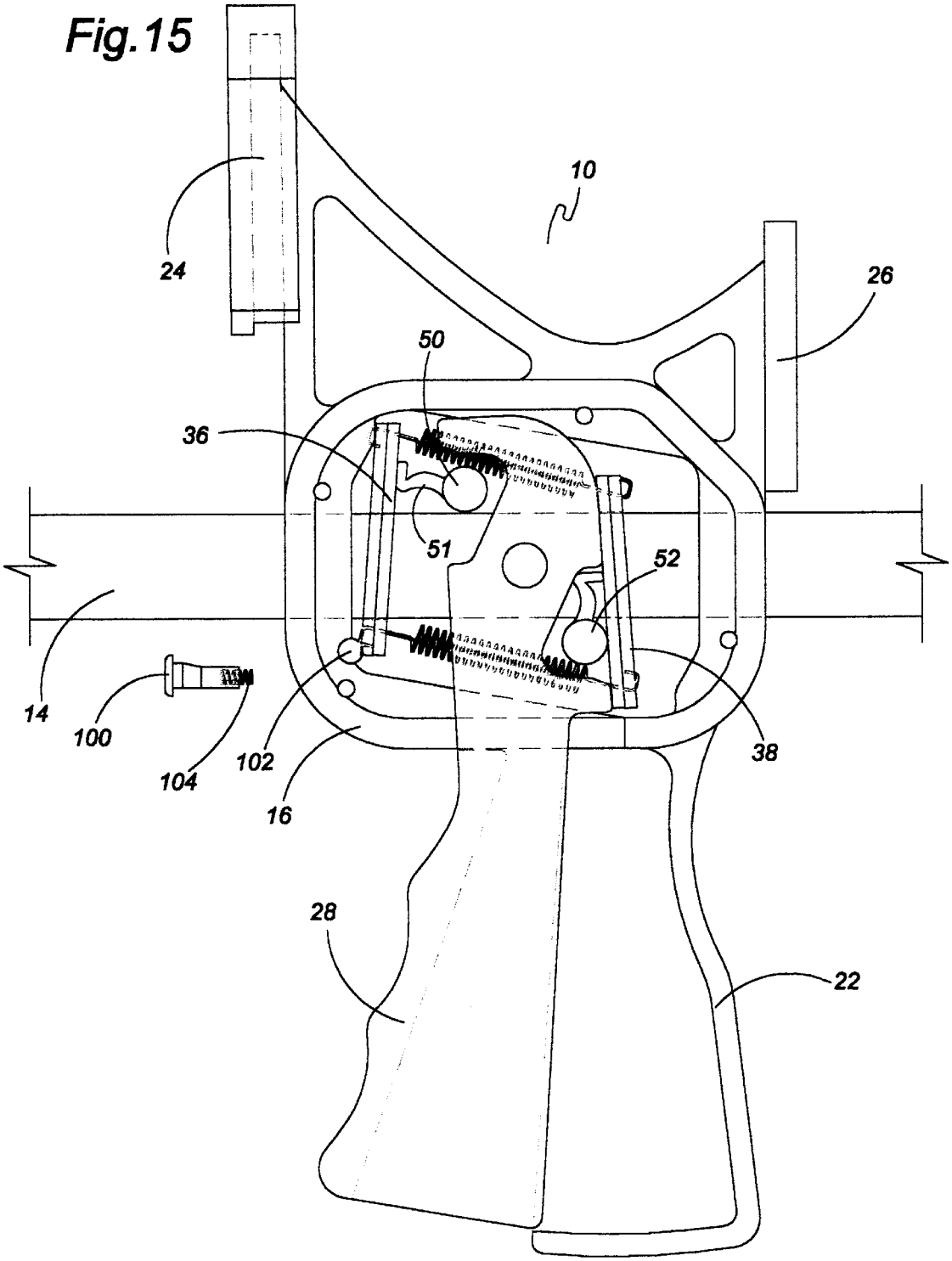
FIG. 15 is an enlarged, partially cut-away left side view of an alternative embodiment of the adjustable bar clamp or bench vice employing a quick release button.

In the alternative embodiment of FIG. 15, quick release button 100 is slidably mounted into hole 102 so that it may be plunged or inwardly biased against the resiliently return biasing force of resilient spring 104. Plunging button 100 inwardly relative to housing 16 causes dog pair 36 to be momentarily released from bar 14 allowing bar 14 to slide freely only while button 100 is depressed. This provides for ease of re-engaging dog pair 36 with bar 14 for quick and repetitive clamping use.

Figure 13:
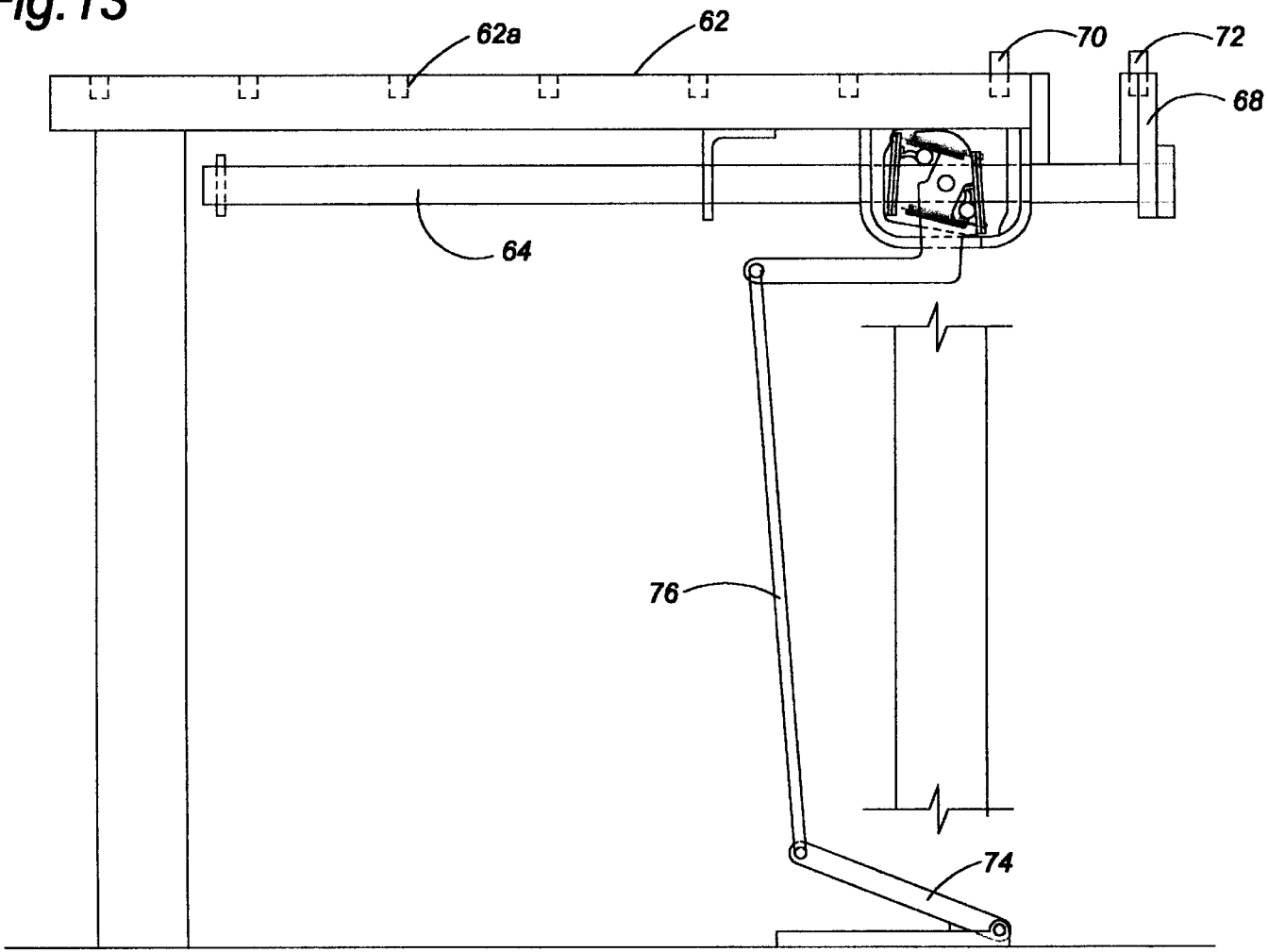
FIG. 13 is a side view of the present invention in a secondary embodiment a clamping and spreading vice.
Figure 14:
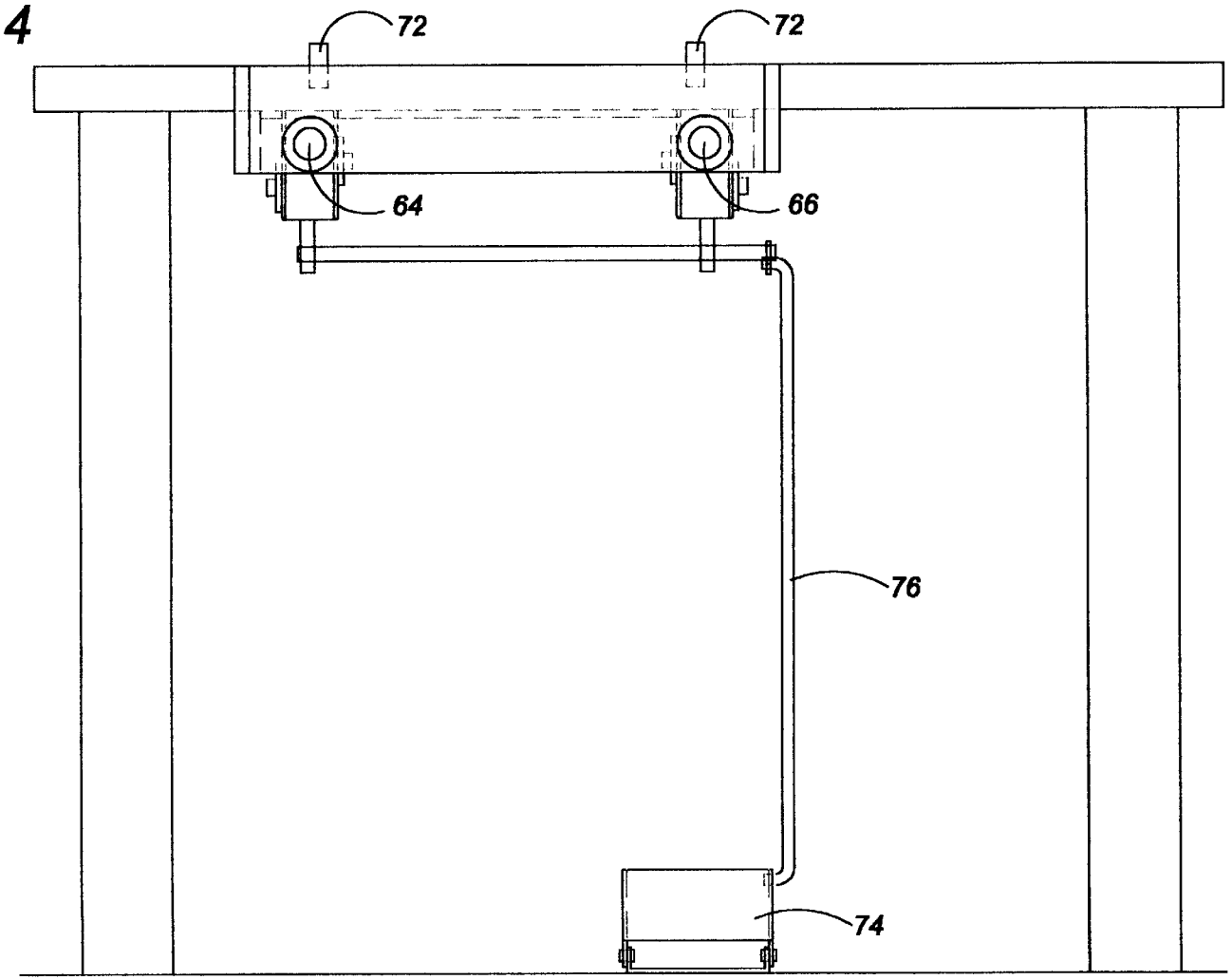
FIG. 14 is a front view of the present invention in a secondary embodiment a clamping and spreading vice.

As shown in FIG. 13 and 14, bench 62 includes two slide bars or pipe 64 and 66 which are attached to a moving bench jaw 68 and which will operate on the same principle as above except for spreading where there are movable dogs or chocks 70 on the bench top and movable jaw dogs 72. The same method of operation for a bench vise is used as above except there may be a foot pedal 74 through linkage 76 to actuate movable jaw 68 to clamp, or to actuate movable jaw 68 for spreading. Bench 62 includes extra bench dog holes 62*a*.

The detent switches, and in particular that legs 51 and 53 may be made of a resilient material such as nylon so as to provide a spring pressure against the dog pairs when either dog pair is in use. The detent switches may also be made with a ball and spring on the contact feet to provide a resilient pressure for proper operation, so long as the pressure applied by the ball and spring exceeds the tension of the extension springs 40 and 42 used to position the dog pairs.

It should be mentioned that there are methods of switching the dog pairs other than as shown and described herein, such as by using linkages or cables. A simple method with few moving parts is shown but is not intended to be limiting. The dog pairs may be arranged together in numbers other than as illustrated, for example one or three. Further, the springs may be in a different arrangement and still accomplish the same effect. Consequently the drawings are to be considered illustrative only, and that changes may be made in the specific construction illustrated and described within the scope of the appended claims.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An adjustable bar clamp for clamping or spreading a workpiece comprising:

a bar having at a first end thereof a first jaw member rigidly mounted thereon, a second jaw member slidably mounted on said bar for selectively adjustable positioning along said bar, a first ratchet means mounted on said bar and cooperating with said second jaw member, said first ratchet means operatively disposed for ratcheting movement of said second jaw member in a first direction along said bar, a second ratchet means mounted on said bar and cooperating with said second jaw member, said second ratchet means operatively oppositely disposed relative to said first ratchet means for ratcheting movement of said second jaw member in a second direction opposite said first direction, selectively engagable first and second ratchet release member for, in a first position, selectively disengaging said first and second ratchet means from ratcheting engagement to one-way directional engagement with said bar and in a second position for engaging and biasing said first or second ratchet means into ratcheting engagement with said bar for said ratcheting movement of said second jaw member in said first or second directions respectively, a ratchet lever pivotally mounted to said second jaw member and cooperating therewith, for selective operation of, said first and second ratchet means when engaged with said bar by said ratchet release members.

2. The bar clamp of claim 1 wherein said first and second ratchet means are first and second ratchet dogs.

3. The bar clamp of claim 2 wherein said first and second ratchet dogs each include a rigid planar plates, each said plate having an aperture therein for snug journalling therethrough of said bar for unidirectional translation.

4. The bar clamp of claim 3 wherein said first and second ratchet dogs are each a pair of said plates.

5. The bar clamp of claim 3 wherein said first and second ratchet dogs are resiliently biased so as to be said operatively disposed on said bar by resilient biasing means.

6. The bar clamp of claim 5 wherein said resilient biasing means is at least one spring mounted to, so as to extend between said first and second ratchet dogs.

7. The bar clamp of claim 5 wherein said at least one spring includes a pair of springs mounted one spring of said pair of springs on opposite ends of said first and second ratchet dogs.

8. The bar clamp of claim 5 wherein said ratchet lever extends between said first and second ratchet dogs and said resilient biasing means resiliently biases said first and second ratchet dogs against either said ratchet lever if said ratchet release members are in said second position or corresponding said ratchet release members if said ratchet release members are in said first position.

9. The bar clamp of claim 8 wherein said ratchet release members are manually pivotable by a user manually rotating a knob, said first ratchet release member mounted between said first ratchet dog and said ratchet lever, said second ratchet release member mounted between said second ratchet dog and said ratchet lever.

10. The bar clamp of claim 9 wherein said first ratchet release member when in said first position holds said first ratchet dog out of a rotational travel path of a first striker on said ratchet lever, against the return biasing force of said resilient biasing means, as said ratchet lever is pivoted, and wherein said second ratchet release member when in first position holds said second ratchet dog out of a rotational travel path of a second striker on said ratchet lever, against the return biasing force of said resilient biasing means, as said ratchet lever is pivoted, said first and second ratchet release members when in said second position releasing said first and second ratchet dogs respectively into said rotational travel paths of said first and second strikers respectively.

11. The bar clamp of claim 10 wherein said resilient biasing means is at least one spring mounted to, so as to extend between said first and second ratchet dogs.

12. The bar clamp of claim 11 wherein said at least one spring includes a pair of springs mounted one spring of said pair of springs on opposite ends of said first and second ratchet dogs.

13. An adjustable bar clamp for clamping or spreading a workpiece comprising:

a bar having at a first end thereof a first jaw member rigidly mounted thereon, a second jaw member slidably mounted on said bar for selectively adjustable positioning along said bar, a first ratchet mounted on said bar and cooperating with said second jaw member, said first ratchet operatively disposed for ratcheting movement of said second jaw member in a first direction along said bar, a second ratchet mounted on said bar and cooperating with said second jaw member, said second ratchet operatively oppositely disposed relative to said first ratchet for ratcheting movement of said second jaw member in a second direction opposite said first direction, selectively engagable first and second ratchet release members for, in a first position, selectively disengaging said first and second ratchet from ratcheting engagement to unidirectional engagement with said bar and in a second position for engaging and biasing said first or second ratchet into ratcheting engagement with said bar for said ratcheting movement of said second jaw member in said first or second directions respectively, a ratchet lever pivotally mounted to said second jaw member and cooperating therewith, for selective operation of, said first and second ratchet when engaged with said bar by said ratchet release members.

14. The bar clamp of claim 13 wherein said first and second ratchet and said bar are used in tandem for use as a bench vice.

15. The bar clamp of claim 14 wherein operation of said bench vice is operated by an adjoining hand lever.

16. The bar clamp of claim 14 wherein operation of said bench vice is operated by an adjoining foot pedal.

17. The bar clamp of claim 13 wherein said first or second ratchets are temporarily released from unidirectional biasing of said bar by a push button member.

* * * * *